US006942600B2

(12) United States Patent
Zeilinger

(10) Patent No.: US 6,942,600 B2
(45) **Date of Patent: *Sep. 13, 2005**

(54) CLIMBING ROCKS WITH FULL OUTER GRIP

(75) Inventor: Brian K. Zeilinger, Janesville, WI (US)

(73) Assignee: PlayStar, Inc., Janesville, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/705,076

(22) Filed: Nov. 10, 2003

(65) Prior Publication Data

US 2004/0097332 A1 May 20, 2004

Related U.S. Application Data

(63) Continuation of application No. 10/365,584, filed on Feb. 12, 2003, now Pat. No. 6,709,365, which is a continuation of application No. 09/544,073, filed on Apr. 6, 2000, now Pat. No. 6,540,645, which is a continuation-in-part of application No. 09/289,038, filed on Apr. 9, 1999, now abandoned.

(51) Int. Cl.[7] ..... A63B 9/00; A63B 17/00

(52) U.S. Cl. ..... 482/35; 482/23; 482/36

(58) Field of Search ..... 482/35–39, 23, 482/52; 248/925; D21/826; 446/314

(56) References Cited

U.S. PATENT DOCUMENTS

| | | | | |
|---|---|---|---|---|
| 5,092,587 A | | 3/1992 | Ulner et al. | |
| 5,125,877 A | | 6/1992 | Brewer | |
| 5,256,116 A | | 10/1993 | Robinson | |
| 5,732,954 A | | 3/1998 | Strickler et al. | |
| 6,074,327 A | | 6/2000 | Franklin | |
| 6,419,610 B1 | * | 7/2002 | Jonas et al. | 482/35 |
| 6,709,365 B2 | * | 3/2004 | Zeilinger | 482/35 |

FOREIGN PATENT DOCUMENTS

| | | |
|---|---|---|
| DE | 4413335 | 10/1995 |
| FR | 2692798 | 6/1992 |
| FR | 2627988 | 3/1998 |

OTHER PUBLICATIONS

Entre Prises 1995 Catalog, Entre Prises USA, Bend, OR.*
Entre Prises 1997 Catalog, Entre Prises USA, Bend, OR.*
Kompan, Inc., "Kompany Early Childhood Edition" (1997).
ChildLife, Inc. "ChildLife The Famous Hunter Green Play Sytems Since 1945" (1998).
American Outdoor Products "Woodplay" (1998).

* cited by examiner

*Primary Examiner*—Jerome W. Donnelly
*Assistant Examiner*—L. Amerson
(74) *Attorney, Agent, or Firm*—Michael Best & Friedrich LLP

(57) ABSTRACT

The invention provides an imitation climbing rock that allows children to simulate rock climbing activity. The climbing rock is adapted to be attached to a wall to simulate a natural rock-like structure. The climbing rock includes a mounting surface, a body (e.g., a continuous side wall) and an endless grip that extends outwardly from the entire circumference of the body. The endless grip provides a hand/foot hold for children seeking to grasp the climbing rock as they attempt to negotiate a wall that includes several of the climbing rocks. The endless grip provides a hand/foot hold regardless of a climbing child's position relative to the climbing rock and no matter how the climbing rock is mounted to the climbing wall.

19 Claims, 2 Drawing Sheets

CLIMBING ROCKS WITH FULL OUTER GRIP

CROSS-REFERENCE TO RELATED APPLICATIONS

This is a continuation of application Ser. No. 10/365,584 filed Feb. 12, 2003, now U.S. Pat. No. 6,709,365 which is a continuation of application Ser. No. 09/544,073 filed Apr. 6, 2000, now U.S. Pat. No. 6,540,645, which is a continuation-in-part of application Ser. No. 09/289,038 filed Apr. 9, 1999, now abandoned.

BACKGROUND OF INVENTION

The invention relates to a climbing rock, and more particularly, to an imitation climbing rock that allows children to simulate rock climbing activity.

Using imitation climbing rocks to simulate outdoor rock climbing activity is well known (see e.g., U.S. Pat. No. 5,125,877). Imitation climbing rocks provide rock climbing enthusiasts with the opportunity to simulate outdoor rock climbing activity at an easily accessible location.

The climbing rocks are normally attached to a wall using a single bolt or threaded rod. The climbing rocks are typically made of varying shapes and textures that affect the level of skill required to maneuver on the climbing wall. In particular, climbing rocks that have minimal hand/foot holds are harder to grasp and make the wall harder to negotiate. Another factor affecting the level of skill required to maneuver on the climbing wall is the position of the climbing rocks on the climbing wall. The closer the climbing rocks are positioned relative to one another, the more climbing rocks there are available for grasping by a climber as the climber maneuvers on the climbing wall.

There are climbing walls or structures that are specifically designed for children. One type of children's climbing wall includes a variety of geometric shapes and openings. The shapes and openings are arranged in a variety of configurations that allow children to maneuver around the climbing wall. This type of climbing wall provides little or no simulation of outdoor rock climbing activity. Another type of children's climbing wall has an inclined climbing surface that has a rock-like texture. A child negotiates this type of climbing wall by grasping various projections that extend up from the inclined surface. This type of climbing wall is usually expensive to manufacture because of the large size and complex geometry of the wall.

One of the problems associated with known imitation climbing rocks is that they generally provide an inadequate number and/or type of hand/foot holds for children. A child negotiating a climbing wall that includes conventional imitation climbing rocks may have trouble finding an effective hand/foot hold. As an example, if the climbing rock illustrated in FIGS. 1 and 2 is mounted upside down on the climbing wall, there is practically, at least for children, no available hand/foot hold on the climbing rock.

American Outdoor Products manufactures products referred to as "Woodplay". The Woodplay line of products relates to multi-colored letter and number climbing devices which are attached to a wall. The child ascends the wall by placing hands and feet onto the side walls of the letter and number climbing devices. The disclosed letter and number climbing devices include side walls that extend perpendicularly outward from the walls such that there is no grip other than the side wall itself. The letter and number climbing devices suffer from the same problem as the rest of the prior art climbing devices (i.e., a child negotiating a climbing wall that includes the disclosed climbing devices may have trouble finding an effective hand/foot hold).

Kompany, Inc. manufactures a line of products referred to as "Kompany Early Childhood Addition". This line of products includes slightly U-shaped climbing devices that are mounted to an inclined wall. Similar to the Woodplay devices and the rest of the prior art, the Kompany climbing devices do not include an endless grip that extends outwardly from the entire circumference of a side wall on the climbing device. The side walls of the Kompany climbing devices merely extend perpendicularly outward from the mounting wall thereby requiring children that are climbing on the wall to place their hands/feet onto the side walls of the climbing devices instead of providing a grip. Therefore, the Kompany climbing devices fail to provide a handhold for a child when the child seeks to grasp the climbing rock from every possible angle as the child maneuvers around on a wall filled with the climbing devices.

Another problem associated with the climbing rock illustrated in FIGS. 1 and 2 is that it has a tendency to loosen as it is used by climbers. Depending on how a climber grasps the imitation climbing rock, the climber may generate a torque on the rock which could unscrew (i.e., loosen) the rock from the climbing wall.

SUMMARY OF THE INVENTION

Accordingly, the invention provides an imitation climbing rock that allows children to simulate rock climbing activity. The climbing rock is adapted to be attached to a wall to simulate a natural rock structure. The climbing rock includes a mounting surface, a body (e.g., a continuous side wall) and an endless grip that extends outwardly from the entire circumference of the body. The endless grip provides a hand/foot hold for children seeking to grasp the climbing rock as they attempt to negotiate a wall that includes several of the climbing rocks. The endless grip provides a hand/foot hold regardless of a climbing child's position relative to the climbing rock and no matter how the climbing rock is mounted to the climbing wall. The body, or side wall, of the climbing rock preferably includes a mounting portion that forms an edge with the mounting surface and a gripping portion where the endless grip extends outwardly from the gripping portion.

In one form, the mounting surface has an irregular shape and includes a void in the mounting surface that defines an inner surface on the side wall.

In another form, the climbing rock includes a plurality of openings that are adapted to receive a plurality of fasteners. The fasteners secure the climbing rock to the climbing wall in such a way as to eliminate the possibility of inadvertently unscrewing the climbing rock from the wall during climbing.

A principal advantage of the invention is to provide a climbing rock that mounts to a climbing wall and includes hand/foot holds that allow children to grasp the climbing rock from any position on the climbing wall regardless of the orientation of the climbing rock on the climbing wall.

Another advantage of the invention is to provide a climbing rock that does not have a tendency to unscrew from a wall when a torque is applied to the climbing rock by a climber during climbing activity.

Other features and advantages of the invention are set forth in the following drawings and claims.

The preceding description of the present invention has been presented for purposes of illustration and description. The description is not intended to limit the invention to the form disclosed herein. Consequently, variations and modifications commensurate with the above teachings, and the skill or knowledge of the prior art, are within the scope of the present invention. It is intended that the appending claims be construed to include alternative embodiments to the extent permitted by the prior art.

DETAILED DESCRIPTION

Figure 3:
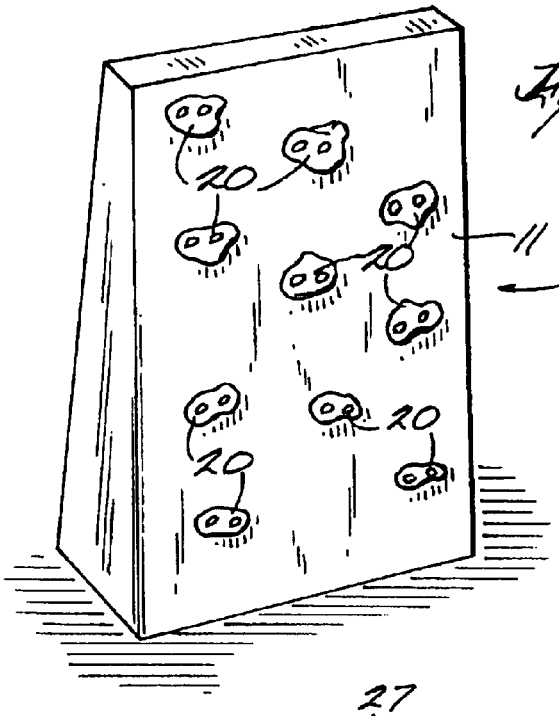
FIG. 3 is a perspective view of a number of climbing rocks of the present invention mounted to an inclined wall.

Several climbing rocks of the present invention are shown in FIG. 3. The climbing rocks 20 are mounted at various locations to an inclined surface 11 on a wall 10. The climbing rocks 20 are shaped to provide the appearance of a natural rock structure when the climbing rocks 20 are mounted to the wall 10. The relative location of the climbing rocks 20 with respect to one another determines the level of difficulty associated with maneuvering on the climbing rocks 20 to ascend and/or descend the wall 10. The skill level required to maneuver on the wall 10 decreases when the climbing rocks 20 are positioned closer together (i.e., when more rocks 20 are added to the wall 10).

FIGS. 4–7 illustrate one form of a climbing rock 20. The climbing rock 20 includes a body 19 having a mounting surface 21, a continuous side wall 22 and an endless grip 23. The continuous side wall 22 includes a front portion 24, a rear portion 25, and an outer surface 26. The front portion 24 and the mounting surface 21 form an edge 27.

The endless grip 23 extends outwardly from the entire circumference of the outer surface 26 on the back portion 25 of the side wall 22. Since the grip 23 extends outward from the entire circumference of the outer surface 26, the grip 23 forms a hand-hold on the climbing rock 20 that a child can grasp from any angle as the child negotiates the wall 10.

Figure 1:
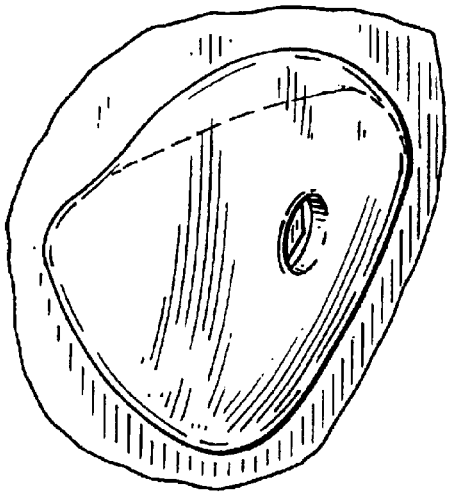
Fig. 1 PRIOR ART
FIG. 1 is a front perspective view of a conventional climbing rock attached to a wall.
Figure 2:
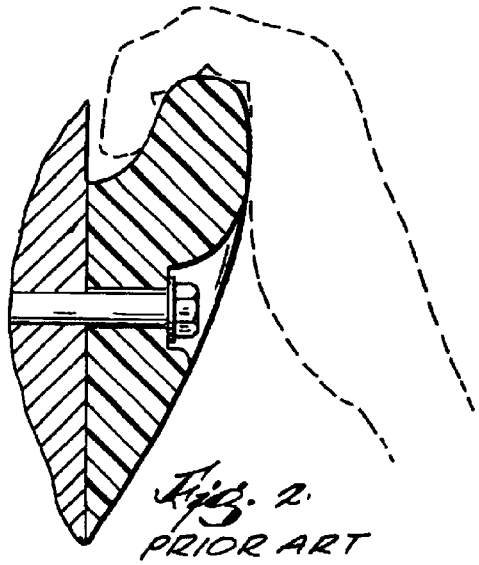
Fig. 2 PRIOR ART
FIG. 2 is a section view of the conventional climbing rock of FIG. 1 taken along line 2—2.
Figure 5:
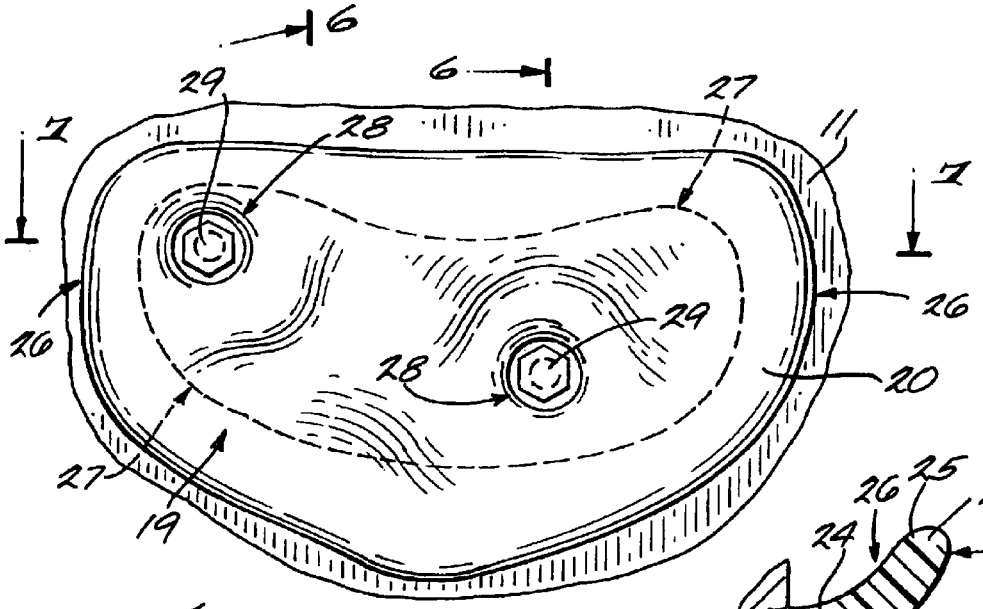
FIG. 5 is a front view of the climbing rock of FIG. 4 attached to a wall.
Figure 4:
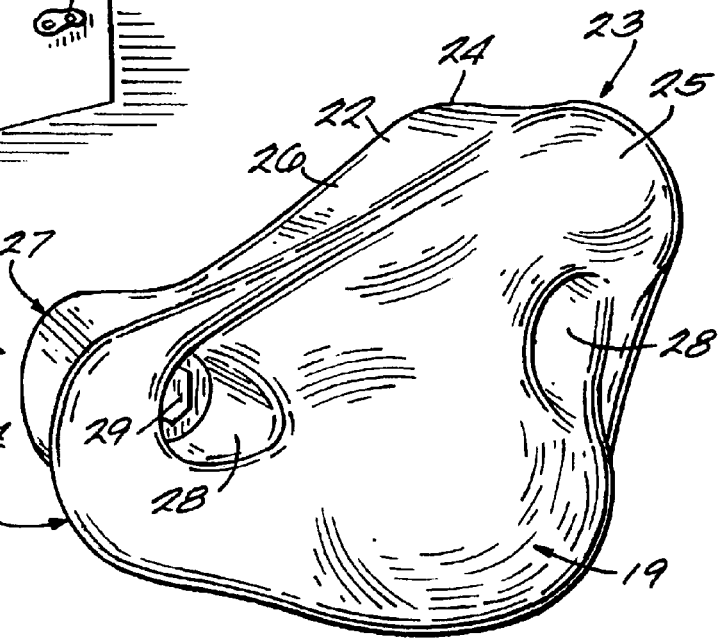
FIG. 4 is a perspective view of a climbing rock of the present invention.
Figure 7:
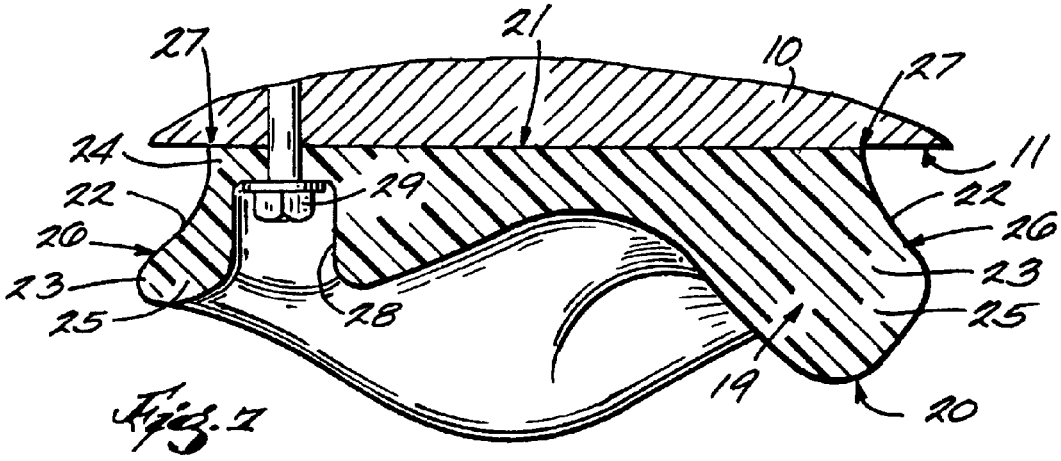
FIG. 7 is a section view of the climbing rock of FIG. 5 taken along line 7—7.

Referring now to FIGS. 4 and 5, the climbing rock 20 includes openings 28 that are adapted to receive fasteners 29. The fasteners 29 secure the climbing rock 20 to the wall 10. The heads of the fasteners 29 are preferably recessed below the contact surface of the climbing wall in order to prevent the fasteners 29 from hindering any gripping of the climbing rock 20. It should be noted that additional openings 28 could be added to the climbing rock 20 without departing from the scope of the present invention.

In a preferred form of the invention, the mounting surface 21 of the climbing rock 20 has an irregular shape that increases the simulated appearance of a natural rock structure. The mounting surface 21 can have any shape as long as the grip 23 of the climbing rock 20 extends outwardly from the entire circumference of the outer surface 26.

Figure 6:
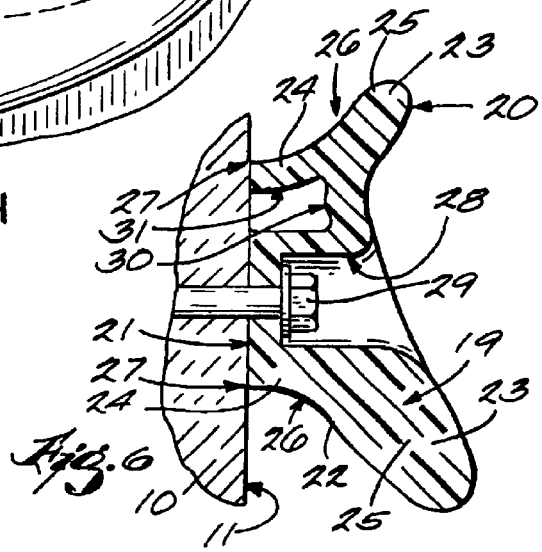
FIG. 6 is a section view of the climbing rock of FIG. 5 taken along line 6—6.

As shown most clearly in FIG. 6, the climbing rock 20 also includes a void 30 extending inward from the mounting surface 21. The void 30 defines an inner surface 31 on the side wall 22. The void 30 serves to facilitate manufacturing the climbing rock 20 by molding. Although only one void 30 is shown in the mounting surface 21, it should be understood that additional voids 30 could be added to further facilitate manufacturing the climbing rock 20 without departing from the scope of the present invention.

The foregoing description of the present invention has been presented for purposes of illustration and description. The description is not intended to limit the invention to the form disclosed herein. Consequently, variations and modifications commensurate with the above teachings, or in the skill or knowledge of the prior art, are within the scope of the present invention. The embodiments described herein are intended to explain the best modes for practicing the invention and to enable others skilled in the art to utilize the invention in the disclosed or other embodiments, and with various modifications required by the particular applications or uses of the present invention. It is intended that the amended claims be construed to include alternative embodiments to the extent permitted by the prior art.

What is claimed is:

1. An imitation climbing rock configured to be attached to a wall, the climbing rock comprising:

a mounting surface configured to engage the wall and defining a distal end of the rock, the mounting surface having a periphery defined by an edge;

a continuous side wall extending from the mounting surface; and an endless grip extending outwardly from the side wall about substantially the entire side wall, the grip extending outwardly beyond the edge defining the periphery of the mounting surface to define a hand-hold formed by the grip and the side wall that facilitates a user grasping the climbing rock;

wherein the endless grip extends outwardly from the side wall different distances at different locations on the side wall to provide differently configured hand-holds at different locations on the rock.

2. The climbing rock of claim 1, further comprising a void in the mounting surface and an opening passing through the mounting surface for receiving a fastener, the opening being distinct from the void.

3. The climbing rock of claim 2, further comprising a second opening passing through the mounting surface for receiving a second fastener, the two openings being separated by at least a portion of the void.

4. The climbing rock of claim 2, wherein the rock is made of plastic and the void is formed during molding of the plastic.

5. The climbing rock of claim 1, wherein the endless grip has a depth in a direction extending away from the mounting surface, the depth of the grip varying along the grip to provide differently configured hand-holds at different locations on the rock.

6. The climbing rock of claim 1, wherein at least one of the side wall and the grip is asymmetrical in shape to simulate a natural rock structure.

7. An imitation climbing rock configured to be attached to a wall, the climbing rock comprising:

a mounting surface configured to engage the wall and defining a distal end of the rock, the mounting surface having a periphery defined by an edge;

a continuous side wall extending from the mounting surface; and an endless grip extending outwardly from the side wall about substantially the entire side wall, the grip extending outwardly beyond the edge defining the periphery of the mounting surface to define a hand-hold formed by the grip and the side wall that facilitates a user grasping the climbing rock;

wherein the endless grip has a depth in a direction extending away from the mounting surface, the depth of the grip varying along the grip to provide differently configured hand-holds at different locations on the rock.

8. The climbing rock of claim 7, further comprising a void in the mounting surface and an opening passing through the mounting surface for receiving a fastener, the opening being distinct from the void.

9. The climbing rock of claim 8, further comprising a second opening passing through the mounting surface for receiving a second fastener, the two openings being separated by at least a portion of the void.

10. The climbing rock of claim 8, wherein the rock is made of plastic and the void is formed during molding of the plastic.

11. The climbing rock of claim 7, wherein the endless grip extends outwardly from the side wall different distances at different locations on the side wall to provide differently configured hand-holds at different locations on the rock.

12. The climbing rock of claim 7, wherein at least one of the side wall and the grip is asymmetrical in shape to simulate a natural rock structure.

13. An imitation climbing rock configured to be attached to a wall, the climbing rock comprising:

a mounting surface configured to engage the wall and defining a distal end of the rock, the mounting surface including an opening passing through the mounting surface for receiving a fastener configured to secure the rock to the wall, and a void distinct from the opening.

14. The climbing rock of claim 13, wherein the rock is made of plastic and the void is formed during molding of the plastic.

15. The climbing rock of claim 13, further comprising second opening passing through the mounting surface for receiving a second fastener, the two openings being separated by at least a portion of the void.

16. The climbing rock of claim 14, further comprising continuous side wall extending from the mounting surface, the void defining an inner surface of the side wall.

17. The climbing rock of claim 16, further comprising endless grip extending outwardly from the side wall about substantially the entire side wall to define a hand-hold formed by the grip and the side wall that facilitates a user grasping the climbing rock.

18. The climbing rock of claim 17, wherein the endless grip extends outwardly from the side wall different distances at different locations on the side wall to provide differently configured hand-holds at different locations on the rock.

19. The climbing rock of claim 17, wherein the endless grip has a depth in a direction extending away from the mounting surface, the depth of the grip varying along the grip to provide differently configured hand-holds at different locations on the rock.

* * * * *